US006131401A

United States Patent [19]

Ueno et al.

[11] Patent Number: 6,131,401

[45] Date of Patent: Oct. 17, 2000

[54] REFRIGERATING SYSTEM

[75] Inventors: Akitoshi Ueno; Takenori Mezaki, both of Osaka, Japan

[73] Assignee: Daikin Industries, Ltd., Osaka, Japan

[21] Appl. No.: 09/147,273

[22] PCT Filed: Apr. 7, 1998

[86] PCT No.: PCT/JP98/01602

§ 371 Date: Nov. 18, 1998

§ 102(e) Date: Nov. 18, 1998

[87] PCT Pub. No.: WO98/45651

PCT Pub. Date: Oct. 15, 1998

[30] Foreign Application Priority Data

Apr. 8, 1997 [JP] Japan ..... 9-089164

[51] Int. Cl.[7] ..... F24F 3/00; F25B 7/00

[52] U.S. Cl. ..... 62/175; 165/208

[58] Field of Search ..... 62/335, 510, 175; 165/208

[56] References Cited

U.S. PATENT DOCUMENTS

| | | | |
|---|---|---|---|
| 5,108,475 | 4/1992 | Briggs | 62/11 |
| 5,318,104 | 6/1994 | Shah et al. | 165/208 |
| 5,335,508 | 8/1994 | Tippmann | 62/335 X |
| 5,447,038 | 9/1995 | Vaynberg | 62/335 X |

FOREIGN PATENT DOCUMENTS

| | | |
|---|---|---|
| 43 32 917A1 | 3/1995 | Germany . |
| 56-160563 | 12/1981 | Japan . |
| 58-178159 | 10/1983 | Japan . |
| 62-094785 | 5/1987 | Japan . |
| 64-70659 | 3/1989 | Japan . |
| 8-226683 | 9/1996 | Japan . |
| WO 90/14566 | 11/1990 | WIPO . |

*Primary Examiner*—William Wayner
*Attorney, Agent, or Firm*—Nixon Peabody LLP; Donald R. Studebaker

[57] ABSTRACT

In a refrigerating/air-conditioning system for a supermarket, a single outdoor unit (60) is connected to a plurality of application units (11, 21, 31, 41, 51), which are connected in parallel to each other. The application units (11, 21, 31, 41, 51) are classified into application units (11, 21, 31) of a first type for forming a two-stage refrigerating cycle with the outdoor unit (60) and application units (41, 51) of a second type for forming a one-stage refrigerating cycle with the outdoor unit (60). The application units (11, 21, 31) of the first type are applied to a freezing showcase (10), a chilling showcase (20) and a storehouse (30), respectively. The application units (41, 51) of the second type are applied to a food processing chamber (40) and a general air-conditioned room (50), respectively.

7 Claims, 2 Drawing Sheets

REFRIGERATING SYSTEM

TECHNICAL FIELD

The present invention relates to a refrigerating system applicable to a supermarket or the like requiring various types of temperature environments.

BACKGROUND ART

A chilling showcase applicable to a supermarket or the like has conventionally been known as disclosed in Japanese Laid-Open Publication No. 62-94785, for example. A showcase of such a type includes a refrigerating system in which a compressor, a condenser, an expansion valve and an evaporator are connected via a refrigerant pipe. The showcase includes not only a display stand for foods but also an air passage for circulating the air into/from the display stand. The evaporator is installed in the air passage.

When the refrigerating system is driven, a refrigerant discharged from the compressor is condensed in the condenser and then the pressure of the refrigerant is reduced by the expansion valve. Subsequently, the refrigerant exchanges heat in the evaporator with the air flowing through the air passage and is evaporated, thereby cooling the air. The cooled air is supplied through the air passage to the display stand, thereby keeping the temperature of the foods at a predetermined low temperature. Such a refrigerating system can keep the foods fresh.

In addition, a supermarket is usually equipped with an air-conditioning system for conditioning the air in an in-store selling area and an employees' office. Such an air-conditioning system is constructed by connecting an outdoor unit placed outside of the store to an indoor unit placed on the ceiling or the like inside the store via a refrigerant pipe and the like. Heat is transported between the outdoor unit and the indoor unit, thereby cooling the air inside the store and the employees' office. The air-conditioning system can keep a comfortable air condition inside the store and the employees' office.

Problems to be Solved

As described above, a refrigerating system and an air-conditioning system have conventionally been provided separately for an area, such as a showcase, where foods are displayed and for an area, such as an in-store selling area and an employees' office, where persons are present, respectively. The refrigerating system and the air-conditioning system have provided appropriate environments required for the respective areas. That is to say, the refrigerating system and the air-conditioning system have heretofore been totally independent of each other.

Thus, it has conventionally been necessary to provide discrete heat sources for a refrigerating system and an air-conditioning system, respectively. More specifically, a condenser and the like need to be provided for a refrigerating system for a showcase and an outdoor unit needs to be provided for an air-conditioning system for conditioning the air inside a store. Accordingly, the freezer and air-conditioning systems required for a supermarket as a whole have been adversely complicated.

Moreover, spaces for housing various units constituting the respective heat sources have recently been required separately. Therefore, the spaces for disposing the freezer and air-conditioning systems have disadvantageously increased these days.

In view of the above-described conventional problems, the present invention has been devised in order to provide a refrigerating system, which can simultaneously condition by itself the air in various types of temperature environments in a supermarket or the like, can simplify the overall construction thereof and can reduce the required installation space.

DISCLOSURE OF INVENTION

In order to accomplish the above-described objective, according to the present invention, a single heat source unit is connected to a plurality of application units of a first type for forming a two-stage refrigerating cycle with the heat source unit and also connected to a plurality of application units of a second type for forming a one-stage refrigerating cycle with the heat source unit, and respectively different temperature environments are set by the application units of these two types.

Solutions

Specifically, the first solution provided by the present invention is a refrigerating system including: a heat source unit (60) including a compressor (61) and a heat-source heat exchanger (62); and a plurality of application units (11, 21, 31, 41, 51), which are connected to the heat source unit (60) via a liquid pipe (72) and a gas pipe (71) and are connected in parallel to each other.

The application units (11, 21, 31, 41, 51) are classified into at least two types of application units forming respectively different refrigerating cycles and including application units of the first type (11, 21, 31) and application units of the second type (41, 51).

Each of the application units (11, 21, 31) of the first type includes an application refrigerant circuit (12, 22, 32) as a closed circuit including a refrigerant heat exchanger (13, 23, 33) and a first-application heat exchanger (16, 26, 36). Each of the refrigerant heat exchangers (13, 23, 33) exchanges heat between a heat-source refrigerant supplied from the heat source unit (60) and an application refrigerant. Each of the first-application heat exchangers (16, 26, 36) exchanges heat between the application refrigerant supplied from an associated one of the refrigerant heat exchangers (13, 23, 33) and the air, thereby conditioning the air at a predetermined temperature. A multi-stage refrigerating cycle is formed between each of the application units (11, 21, 31) of the first type and the heat source unit (60).

On the other hand, each of the application units (41, 51) of the second type includes a second-application heat exchanger (46, 56) for directly exchanging heat between the refrigerant supplied from the heat source unit (60) and the air, thereby conditioning the air at a predetermined temperature. A one-stage refrigerating cycle is formed between the application units (41, 51) of the second type and the heat source unit (60).

It is noted that each of the refrigerant heat exchangers (13, 23, 33) in the application units (11, 21, 31) of the first type is sometimes called "cascade heat exchanger".

According to the first solution, the application units (11, 21, 31) of the first type perform operations with the heat source unit (60) in multi-stage refrigerating cycles. Thus, for example, if the application heat exchangers (16, 26, 36) perform heat absorption operation, cold heat at a relatively low temperature can be obtained.

On the other hand, the application units (41, 51) of the second type perform operations with the heat source unit (60) in one-stage refrigerating cycles. Thus, for example, if the application heat exchangers (46, 56) perform heat absorption operation, the temperature of the resulting cold heat becomes higher than that of the cold heat obtained by the application units of the first type.

As a result, cold heat can be obtained so as to satisfy the requirements of respective environments in which the application units (11, 21, 31, 41, 51) are installed.

The second solution provided by the present invention is a refrigerating system including not only the components of the first solution, but also control means (81) for controlling the heat source unit (60) and the respective application units (11, 21, 31, 41, 51) such that a supply air temperature or a suction air temperature of each of the application units (11, 21, 31, 41, 51) becomes a predetermined desired temperature. In addition, the refrigerating system further includes setting changing means (82) for outputting such a change signal to the control means (81) that if any of the application units (e.g., 11) is so lacking in refrigerating power as to have a supply air temperature or a suction air temperature not reaching the desired temperature thereof, the desired temperature of another application unit (e.g., 51) is changed so as to improve the power of the application unit (11).

In accordance with the second solution, if any of the application units (e.g., 11) is required to exhibit particularly stable refrigerating power, then the power of another application units (e.g., 51) is decreased so as to maintain the power of the application unit (11). In other words, operations are performed in such a manner as to prioritize the application unit (11) that should exhibit stable refrigerating power.

In the third solution provided by the present invention, the second solution is modified such that the setting changing means (82) outputs such a change signal that if any of the application units (11, 21 or 31) of the first type is so lacking in refrigerating power as to have a supply air temperature or a suction air temperature not reaching the desired temperature thereof, the desired temperature of any of the application units (41 or 51) of the second type is changed.

In the fourth solution provided by the present invention, the third solution is modified such that temperature sensor means (Th-r) for sensing the supply air temperatures or the suction air temperatures of the application units (11, 21, 31, 41, 51) are further provided. Each of the application heat exchangers (16, 26, 36, 46, 56) of the application units (11, 21, 31, 41, 51) is constituted by an evaporator for evaporating a refrigerant. The setting changing means (82) is constituted so as to receive outputs of the temperature sensor means (Th-r) and output a change signal for raising the desired temperature of any of the application units (41 or 51) of the second type if the supply air temperature of any of the application units (11, 21 or 31) of the first type is higher than the desired temperature thereof by a predetermined difference or more.

In accordance with the third and the fourth solutions, the power of the application units (11, 21, 31) of the first type is prioritized over the application units (41, 51) of the second type. That is to say, operations are performed so as to obtain cold heat at a relatively low temperature for the application units (11, 21, 31) of the first type.

In the fifth solution provided by the present invention, the first solution is adapted such that the application units (11, 21) of the first type are provided for showcases (10, 20) for displaying foods in a supermarket, and that the application unit (51) of the second type is provided indoors for conditioning the air in the supermarket.

In accordance with the fifth solution, various types of temperature environments required for the showcases (10, 20) and for the selling area in the supermarket are realized by a single system.

Effects of the Invention

In accordance with the first solution, the single heat source unit (60) is connected to the application units (11, 21, 31) of the first type for forming a two-stage refrigerating cycle with the heat source unit (60) and to the application units (41, 51) of the second type for forming a onestage refrigerating cycle with the heat source unit (60). Thus, respectively different temperature environments can be secured for the application units (11, 21, 31, 41, 51) of these two types.

This makes it possible to provide many types of temperature environments having greatly different temperature levels by using a system including only one heat source unit (60). In particular, it is no longer necessary to provide a refrigerating system and an air-conditioning system separately for the respective temperature environments, as has conventionally done in a supermarket. As a result, temperature environments complying with various demands can be obtained while providing a simplified system that can considerably reduce the required installation area.

In accordance with the second solution, if there is any application unit (e.g., 11) lacking in power, the desired temperature of another application unit (e.g., 51) is changed so as to recover the power of the application unit (11). Thus, if there is any application unit (11) required to exhibit particularly stable refrigerating power, the power of the application unit (11) can be maintained. That is to say, since the power maintenance of a particular application unit (11) is prioritized, required power can be obtained for the particular application unit (11) without increasing the required power of the entire system.

In accordance with the third and the fourth solutions, the control of the refrigerating power of the application units (11, 21, 31) of the first type is prioritized over the control of the refrigerating power of the application units (41, 51) of the second type. Thus, it is possible to prioritize the power maintenance of the application units (11, 21, 31) of the first type requiring particularly high refrigerating power. That is to say, it is considered that the application units (11, 21, 31) of the first type, which can exhibit superior refrigerating power, are often used as application units required for exhibiting particularly stable refrigerating power. In such a case, by prioritizing the control of the application units (11, 21, 31) of the first type, it is possible to prevent, with certainty, the power of the application units (11, 21, 31) from being too weakened to meet the constant refrigerating power requirements.

In accordance with the fifth solution, the application units (11, 21) of the first type are provided for showcases (10, 20) for displaying foods in a supermarket, and the application unit (51) of the second type is provided indoors for conditioning the air in the supermarket. Thus, various types of temperature environments required for a supermarket are realized by a single system. Furthermore, since the control of the application units (11, 21) of the first type is prioritized, the contents of the showcases (10, 20) can be kept at a constant, low temperature. As a result, since foods can be kept fresh for a long period of time, the practicality of the system can be improved.

BEST MODE FOR CARRYING OUT THE INVENTION

Figure 1:
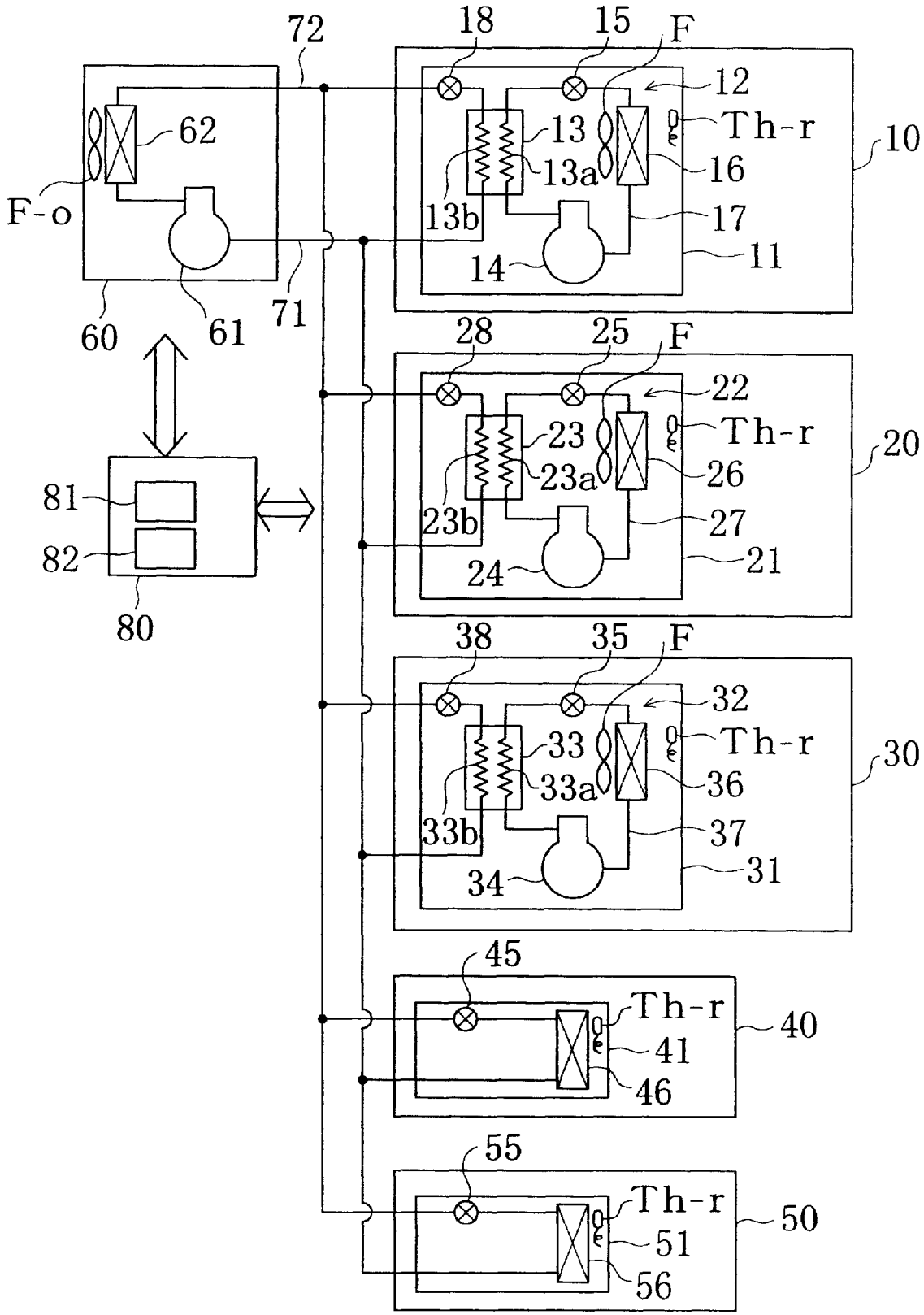
FIG. 1 is a piping diagram of a refrigerating/air-conditioning system in an embodiment of the present invention.

Hereinafter, an embodiment of the present invention will be described in detail with reference to the accompanying drawings.

In this embodiment, the refrigerating system of the present invention is applied to a refrigerating/air-conditioning system for a supermarket.

Thus, various temperature environments required for respective areas such as a selling area and an employees' office in a supermarket will be described.

In the selling area of the supermarket, a freezing showcase (10) in which frozen foods are displayed and a chilling showcase (20) in which refrigerated foods are displayed are disposed. For example, an in-case temperature environment of −20° C. is required for the freezing showcase (10) and an in case temperature environment of 0° C. is required for the chilling showcase (20).

In the supermarket, there are a storehouse (30) or a so-called "backyard" for storing various kinds of foods therein, a food processing chamber (40) in which employees do various work such as packing the foods, and a general air-conditioned room (50) such as the selling area and the employees' office where persons are present. Respectively different temperature environments are required for these rooms (30 to 50). Specifically, a temperature environment of −2° C. is required for the storehouse (30), a temperature environment of 15° C. is required for the food processing chamber (40) and a temperature environment of 25° C. is required for the general air-conditioned room (50).

Next, the refrigerating/air-conditioning system of this embodiment will be described.

The refrigerating/air-conditioning system includes: an outdoor unit (60) as a heat source unit; and three refrigerating units (11, 21, 31) and two air-conditioning units (41, 51) as application units. The refrigerating units (11, 21, 31) and the air-conditioning units (41, 51) are provided for the freezing showcase (10), the chilling showcase (20), the storehouse (30), the food processing chamber (40) and the general air-conditioned room (50), respectively.

First, the outdoor unit (60) will be described.

The outdoor unit (60) is installed outside of the supermarket and includes a compressor (61) and an outdoor heat exchanger (62) as a heat-source heat exchanger. The outdoor heat exchanger (62) is connected to a refrigerant outlet of the compressor (61) and an outdoor fan (F-o) is disposed in the vicinity of the outdoor heat exchanger (62).

An inlet of the compressor (61) is connected to the respective refrigerating units (11, 21, 31) and the respective air-conditioning units (41, 51) via a gas connecting pipe (71). The outdoor heat exchanger (62) is connected on the liquid side to the respective refrigerating units (11, 21, 31) and the respective air-conditioning units (41, 51) via a liquid connecting pipe (72). That is to say, each of the gas connecting pipe (71) and the liquid connecting pipe (72) is branched into a plurality of branched pipes, and the ends of each pair of branched pipes are connected to the gas side and the liquid side of the corresponding one of the refrigerating units (11, 21, 31) and the air-conditioning units (41, 51).

Next, the refrigerating units (11, 21, 31) and the air-conditioning units (41, 51) will be described.

The refrigerating units (11, 21, 31) are application units of the first type installed in the freezing showcase (10), the chilling showcase (20) and the storehouse (30), respectively. On the other hand, the air-conditioning units (41, 51) are application units of the second type installed in the food processing chamber (40) and the general air-conditioned room (50), respectively.

Each of the refrigerating units (11, 21, 31) of the freezing showcase (10), the chilling showcase (20) and the storehouse (30) includes an application refrigerant circuit (12, 22, 32) formed as a closed circuit. Each of the application refrigerant circuits (12, 22, 32) is constituted so as to exchange heat with the refrigerant supplied from the outdoor unit (60) via the liquid connecting pipe (72).

More specifically, each of the refrigerating units (11, 20 21, 31) includes a refrigerant heat exchanger (13, 23, 33) for exchanging heat in the application refrigerant circuit (12, 22, 32) with the refrigerant supplied from the outdoor unit (60) via the liquid connecting pipe (72). It is noted that such a refrigerant heat exchanger (13, 23, 33) is sometimes called "cascade heat exchanger" (or cascade condenser) for cooling the condensation heat of a lower-temperature refrigerant with the evaporation heat of a higher-temperature refrigerant.

Each of the application refrigerant circuits (12, 22, 32) is constituted by connecting a compressor (14, 24, 34), a condensing section **(13*a*, 23*a*, 33*a*), an expansion valve (15, 25, 35) and an evaporator (16, 26, 36) in this order via a refrigerant pipe (17, 27, 37). The condensing section (13*a*, 23*a*, 33*a*) functions as an application heat-exchanging section for each refrigerant heat exchanger (13, 23, 33). The evaporator (16, 26, 36) functions as a first-application heat exchanger. And a fan (F) is disposed in the vicinity of each evaporator (16, 26, 36)**.

An expansion valve (18, 28, 38) is provided for each branched pipe of the liquid connecting pipe (72) extending from the outdoor unit (60). Each expansion valve (18, 28, 38) provided for a corresponding branched pipe of the liquid connecting pipe (72) is connected on the lower-pressure side to an evaporating section **(13*b*, 23*b*, 33*b*) functioning as a heat-source heat-exchanging section of a corresponding refrigerant heat exchanger (13, 23, 33)**.

Thus, a so-called "multiple" two-stage refrigerating system, in which a plurality of application circuits (secondary circuits) are connected to a single heat-source circuit (primary circuit), is formed between the outdoor unit (60) and the respective refrigerating units (11, 21, 31) of the freezing showcase (10), the chilling showcase (20) and the storehouse (30).

That is to say, a primary refrigerant circuit includes: the compressor (61) and the outdoor heat exchanger (62) of the outdoor unit (60); and the expansion valve (18, 28, 38) and the evaporating section **(13*b*, 23*b*, 33*b*) of the refrigerant heat exchanger (13, 23, 33) of each refrigerating unit (11, 21, 31). On the other hand, a secondary refrigerant circuit includes: the compressor (14, 24, 34); the condensing section (13*a*, 23*a*, 33*a*) of the refrigerant heat exchanger (13, 23, 33); the expansion valve (15, 25, 35); and the evaporator (16, 26, 36) of each refrigerating unit (11, 21, 31)**. Heat is transported between these refrigerant circuits.

Next, the air-conditioning units (41, 51) for the food processing chamber (40) and the general air-conditioned room (50) will be described.

Each of the air-conditioning units (41, 51) includes an indoor heat exchanger (46, 56) functioning as a second-application heat exchanger. On the other hand, an expansion valve (45, 55) is provided for each branched pipe of the liquid connecting pipe (72) extending from the outdoor unit (60). Each expansion valve (45, 55) provided for a corresponding branched pipe of the liquid connecting pipe (72) is connected on the lower-pressure side to a corresponding indoor heat exchanger (46, 56).

Thus, a one-stage refrigerating cycle is formed by connecting the compressor (61) and the outdoor heat exchanger (62) of the outdoor unit (60) to the expansion valve (45, 55) and the indoor heat exchanger (46, 56) of the air-conditioning units (41, 51) for the food processing chamber (40) and the general air-conditioned room (50) in this order between the outdoor unit (60) and the air-conditioning units (41, 51) for the food processing chamber (40) and the general air-conditioned room (50).

More specifically, a refrigerant discharged from the compressor (61) of the outdoor unit (60) is condensed in the outdoor heat exchanger (62). Next, the pressure of the condensed refrigerant is reduced by the expansion valve (45, 55) of each air-conditioning unit (41, 51). Then, the refrigerant exchanges heat in the indoor heat exchanger (46, 56) with the indoor air and is evaporated.

Various kinds of sensors are provided for the refrigerating/air-conditioning system. Specifically, a temperature sensor (Th-r) is provided as temperature sensing means for sensing a supply air temperature or a suction air temperature for each of the refrigerating units (11, 21, 31) and air-conditioning units (41, 51). It is noted that the temperature sensor (Th-r) of this embodiment actually senses a supply air temperature.

Although not shown in FIG. 1, not only the temperature sensors (Th-r) but also sensors for sensing the outlet pipe temperature, the outlet pressure, the inlet pressure and the like of each compressor (61, 14, 24, 34) are provided for the refrigerating/air-conditioning system.

A controller (80) is further provided for the refrigerating/air-conditioning system. The controller (80) includes a control section (control means)(81) and a setting changing section (setting changing means)(82).

The control section (81) controls the operating capacity of each compressor (61, 14, 24, 34), the opening degree of each expansion valve (15, 18, 25, 28, 35, 38, 45, 55) and the like, thereby realizing the above-described temperature environments for the respective refrigerating units (11, 21, 31) and the respective air-conditioning units (41, 51). In other words, the control section (81) controls the respective units such that the supply air temperature or the suction air temperature of each of the refrigerating units (11, 21, 31) and air-conditioning units (41, 51) becomes a predetermined desired temperature.

The setting changing section (82) is constituted so as to receive the outputs of the temperature sensors (Th-r) and to output a change signal to the control section (81) such that when the supply air temperature or the suction air temperature of the refrigerating unit (11, 21) for the freezing showcase (10) or the chilling showcase (20) is higher than the desired temperature thereof by a predetermined difference, the desired temperature of the air-conditioning unit (51) for the general air-conditioned room (50) becomes higher than the current temperature thereof by the predetermined difference. The predetermined difference for raising the desired temperature of the air-conditioning unit (51) for the general air-conditioned room (50) is 5 degrees, for example.

Next, the operation of the refrigerating/air-conditioning system will be described.

When the operation is started, the compressors (61, 14, 24, 34) of the outdoor unit (60) and the respective refrigerating units (11, 21, 31) are driven. The operating capacities of the compressors (61, 14, 24, 34), the opening degrees of the expansion valves (15, 18, 25, 28, 35, 38, 45, 55) and the numbers of revolution of the fans (F-o, F) are controlled by the control section (81). The supply air temperatures and the suction air temperatures of the respective refrigerating units (11, 21, 31) and air-conditioning units (41, 51) are also controlled so as to reach the respectively predetermined desired temperatures.

As described above, since a two-stage refrigerating cycle is formed between the refrigerating units (11, 21, 31) of the freezing showcase (10), the chilling showcase (20) and the storehouse (30) and the outdoor unit (60), cold heat at a relatively low temperature is obtained. In such a state, the temperatures of the respective units are set at the above-described values. On the other hand, since a one-stage refrigerating cycle is formed between the air-conditioning units (41, 51) of the food processing chamber (40) and the general air-conditioned room (50) and the outdoor unit (60), cold heat at a relatively high temperature is obtained as compared with the refrigerating units (11, 21, 31). In such a state, the temperatures of the respective units are also set at the above-described values.

Figure 2:
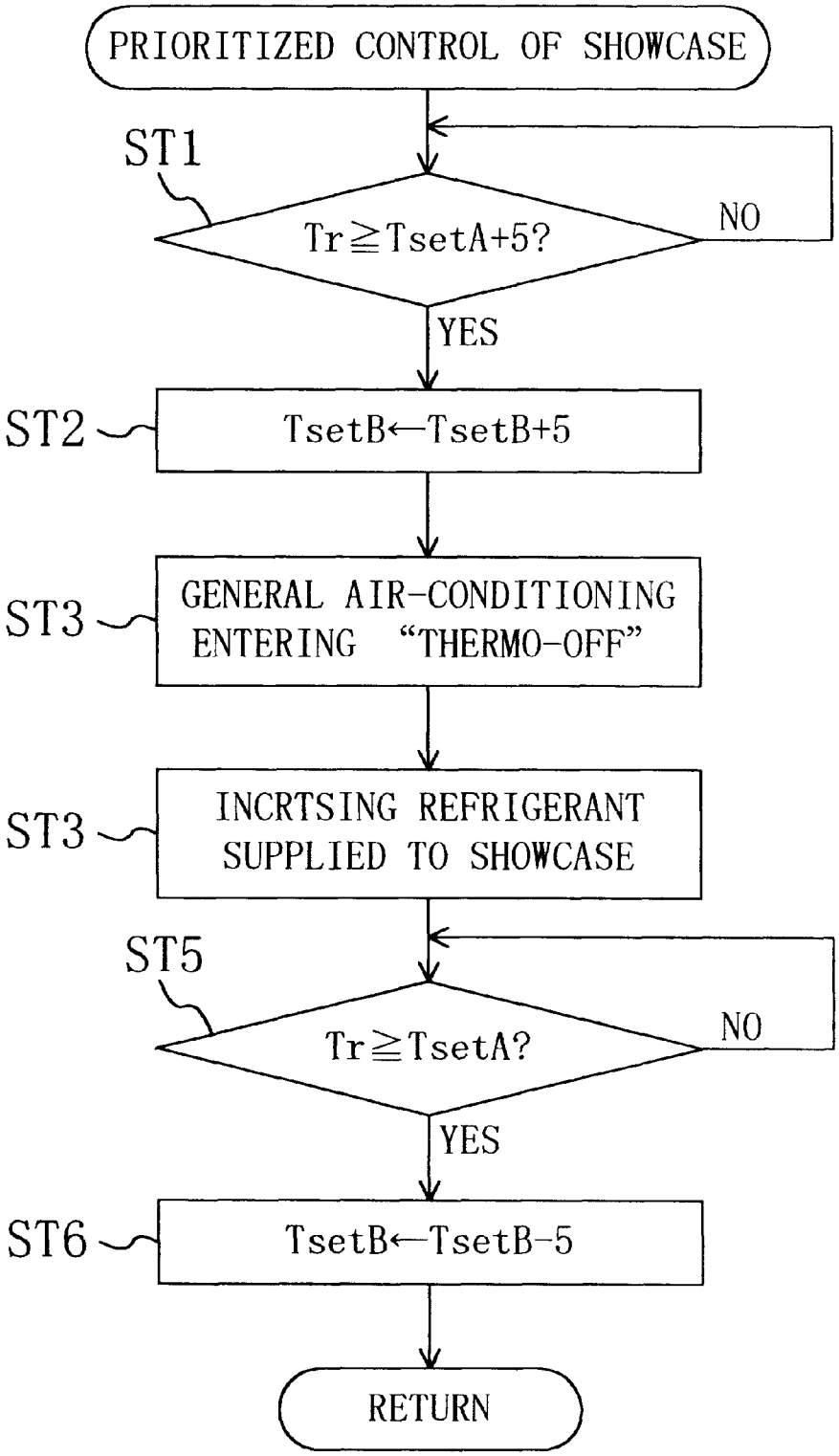
FIG. 2 is a flow chart illustrating a procedure of the prioritized control over a showcase.

Next, an operation performed when any of the refrigerating units is lacking in refrigerating power will be described as a feature of this embodiment with reference to the flow chart illustrated in FIG. 2.

A refrigerating unit is likely to be lacking in refrigerating power, for example, when the inner temperature of the freezing showcase (10) or the chilling showcase (20) is raised by the display of additional food products in the freezing showcase (10) or the chilling showcase (20) or when the outdoor air-conditioning power of the outdoor unit (60) is deteriorated by dirt attached to the outdoor heat exchanger (62) or the like. Hereinafter, an operation to be performed when the inner temperature of the freezing showcase (10) is raised will be described.

First, in Step ST1, the temperature (Tr) of the air supplied to the freezing showcase (10), which is sensed by the supply air temperature sensor (Th-r), is compared with the desired temperature setting (TsetA) of the freezing showcase (10). The desired temperature setting (TsetA) is −20° C., for example. If the supply air temperature (Tr) is higher than the desired temperature setting (TsetA) by a predetermined difference t or more, the query in Step ST1 is affirmed (YES branch) and the procedure advances to Step ST2. The predetermined difference t is 5 degrees, for example.

Next, in Step ST2, the desired temperature setting (TsetB) of the general air-conditioned room (50) is raised by the predetermined difference. In this case, the desired temperature setting (TsetB) is raised by 5 degrees and the heat quantity to be cooled for the general air-conditioned room (50) is reduced.

Thus, if the room temperature of the general air-conditioned room (50) has substantially reached the desired temperature setting (TsetB), then the actual room temperature becomes lower than the desired temperature setting (TsetB). Next, the procedure advances from Step ST2 to Step ST3, in which the air-conditioning operation of the air-conditioning unit (51) of the general air-conditioned room (50) is suspended, thereby entering a so-called "thermo-off" state. The thermo-off state is entered by fully closing the expansion valve (55).

In such a situation, the air-conditioning unit (51) of the general air-conditioned room (50) does not restart the air-conditioning operation until the room temperature becomes higher than the original desired temperature by more than 5 degrees. In other words, the air-conditioning unit (51) does not enter a so-called "thermo-on" state until the room temperature becomes higher than the original desired temperature by more than 5 degrees.

Thereafter, the procedure advances to Step ST4. As a result of the above-described operation, the supply of the refrigerant to the air-conditioning unit (51) of the general air-conditioned room (50) is not necessary until the "thermo-on" occurs. Thus, in this step, a large amount of refrigerant can be supplied to the refrigerating unit (11) of the freezing showcase (10) for a predetermined period of time. In other words, the amount of the refrigerant supplied to the refrigerating unit (11) goes on increasing until the air-conditioning unit (51) enters the "thermo-on" state.

As a result, the power of the refrigerating unit (11) of the freezing showcase (10) is increased and the supply air temperature (Tr) of the freezing showcase (10) becomes rapidly closer to the desired temperature setting (TsetA).

Subsequently, in Step ST5, it is determined whether or not the supply air temperature (Tr) of the freezing showcase (10) has reached the desired temperature setting (TsetA). If it is determined that the supply air temperature (Tr) of the freezing showcase (10) has reached the desired temperature setting (TsetA), the query in Step ST5 is affirmed (YES branch) and the procedure advances to Step ST6. In Step ST6, the desired temperature setting (TsetB) of the general air-conditioned room (50) is reset at the original value. That is to say, the desired temperature setting (TsetB) is lowered by 5 degrees.

As a result, the heat quantity to be cooled for the general air-conditioned room (50) is increased and the air in the general air-conditioned room (50) can be conditioned satisfactorily.

It is noted that if the temperature sensors (Th-r) are supposed to sense the suction air temperature, the control operation is performed in the same manner as the above-described case.

As described above, in this embodiment, refrigerating units (11, 21, 31) of the first type for forming a two-stage refrigerating cycle and air-conditioning units (41, 51) of the second type for forming a one-stage refrigerating cycle are provided for a single outdoor unit (60). This makes it possible to provide many types of temperature environments having greatly different temperature levels by using a single refrigerating/air-conditioning system.

In particular, it is no longer necessary to provide refrigerating systems and air-conditioning systems separately for the respective temperature environments, as has conventionally done in a supermarket. As a result, temperature environments complying with various demands can be obtained while providing a simplified system that can considerably reduce the required installation area.

Moreover, in this embodiment, even if the refrigerating power of the entire refrigerating/air-conditioning system is lacking, the desired temperature setting (TsetB) of the general air-conditioned room (50) is forcibly changed and the operation is controlled while prioritizing the temperature environment of the freezing showcase (10) or the like. Thus, the foods can be kept fresh for a long period of time.

Furthermore, since a two-stage refrigerating cycle is formed between the refrigerating units (11, 21, 31) and the outdoor unit (60), a desired low temperature can be obtained only by changing the settings of the application refrigerant circuits (12, 22, 32) as the refrigerant circuits having lower temperatures. As a result, the refrigerating/air-conditioning system can be used in a wider variety of applications and the universality of the refrigerating/air-conditioning system can be improved.

It is noted that, in this embodiment, the present invention has been described as being applied to a refrigerating/air-conditioning system for a supermarket. Alternatively, the present invention is also applicable to a refrigerating system for a building.

INDUSTRIAL APPLICABILITY

As is apparent from the foregoing description, the refrigerating system of the present invention is effectively applicable to a situation requiring respectively different temperature environments. The refrigerating system of the present invention is applicable particularly suitably to refrigerating a showcase and conditioning the indoor air in a supermarket.

What is claimed is:

1. A refrigerating system comprising:

a heat-source unit (60) including a compressor (61) and a heat-source heat exchanger (62); and a plurality of application units (11, 21, 31, 41, 51), which are connected to the heat-source unit (60) via a liquid pipe (72) and a gas pipe (71) and are connected in parallel to each other, characterized in that the application units (11,21, 31,41, 5 1) are classified into at least two types of application units forming respectively different refrigerating cycles and including application units of a first type (11, 21, 31) and application units of a second type (41, 51), and that each of the application units (11, 21, 31) of the first type includes an application refrigerant circuit (12, 22, 32) as a closed circuit including a refrigerant heat exchanger (13, 23, 33) and a first-application heat exchanger (16, 26, 36), a multi-stage refrigerating cycle being formed between each of the application units (11,21,31) of the first type and the heat source unit (60), each of the refrigerant heat exchanges (13, 23, 33) exchanging heat between a heat-source refrigerant supplied from the heat source unit (60) and an application refrigerant, each of the first-application heat exchanges (16, 26, 36) exchanging heat between the application refrigerant supplied from an associated one of the refrigerant heat exchangers (13, 23 33) and the air, thereby conditioning the air at a predetermined temperature, and that each of the application units (41, 51) of the second type includes a second-application heat exchanger (46, 56) for exchanging heat between the refrigerant supplied from the heat source unit (60) and the air, thereby conditioning the air at a predetermined temperature, a one-stage refrigerant cycle being formed between the application units (41, 51) of the second type and the heat source unit (60), wherein each of the application units (11, 21) of the first type is provided in a showcase (10, 20) for displaying foods in a supermarket; and any one of the application units (41 or 51) of the second type are provided for conditioning the air in the supermarket.

2. A refrigerating system comprising:

a heat-source unit (60) including a compressor (61) and a heat-source heat exchanger (62);

a plurality of application units (11, 21, 31, 41, 51), which are connected to the heat-source unit (60) via a liquid pipe (72) and a gas pipe (71) and are connected in parallel to each other, control means (81) for controlling the heat source unit (60) and the respective application units (11, 21, 31, 41,

51) such that a supply air temperature or a suction air temperature of each of the application units (11, 21, 31, 41, 51) becomes a predetermined desired temperature; and setting changing means (82) for outputting such a change signal to the control means (81) that if any of the application units (11, 21, 31, 41 or 51) is so lacking in refrigerating power as to have a supply air temperature or a suction air temperature not reaching the desired temperature, the desired temperature of another application unit (11, 21, 31, 41 or 51) is changed so as to recover the power of the application unit (11, 21 or 31);

characterized in that the application units (11,21, 31,41, 5 1) are classified into at least two types of application units forming respectively different refrigerating cycles and including application units of a first type (11, 21, 31) and application units of a second type (41, 51), and that each of the application units (11, 21, 31) of the first type includes an application refrigerant circuit (12, 22, 32) as a closed circuit including a refrigerant heat exchanger (13, 23, 33) and a first-application heat exchanger (16, 26, 36), a multi-stage refrigerating cycle being formed between each of the application units (11,21, 31) of the first type and the heat source unit (60);

each of the refrigerant heat exchanges (13, 23, 33) exchanging heat between a heat-source refrigerant supplied from the heat source unit (60) and an application refrigerant, each of the first-application heat exchanges (16, 26, 36) exchanging heat between the application refrigerant supplied from an associated one of the refrigerant heat exchanges (13, 23 33) and the air, thereby conditioning the air at a predetermined temperature, and that each of the application units (41, 51) of the second type includes a second-application heat exchanger (46, 56) for exchanging heat between the refrigerant supplied from the heat source unit (60) and the air, thereby conditioning the air at a predetermined temperature, a one-stage refrigerant cycle being formed between the application units (41, 51) of the second type and the heat source unit (60).

3. The refrigerating system of claim 2, characterized in that the setting changing means (82) outputs such a change signal that if any of the application units (11, 21 or 31) of the first type is so lacking in refrigerating power as to have a supply air temperature or a suction air temperature not reaching the desired temperature, the desired temperature of any of the application units (41 or 51) of the second type is changed.

4. The refrigerating system of claim 3, further comprising temperature sensing means (Th-r) for sensing the supply air temperatures or the suction air temperatures of the application units (11, 21, 31, 41, 51), characterized in that each of the application heat exchangers (16, 26, 36, 46, 56) of the application units (11, 21, 31, 41, 51) is constituted by an evaporator for evaporating a refrigerant, and that the setting changing means (82) is constituted so as to receive outputs of the temperature sensing means (Th-r) and output a change signal for raising the desired temperature of any of the application units (41 or 51) of the second type if the supply air temperature of any of the application units (11, 21 or 31) of the first type is higher than the desired temperature thereof by a predetermined difference or more.

5.The refrigeration system of claim 4, characterized in that each of the application units (11, 21) of the first type is provided in a showcase (10, 20) for displaying foods in a supermarket, and any one of the application units (41 or 51) of the second type are provided for conditioning the air in the supermarket.

6. The refrigeration system of claim 3, characterized in that each of the application units (11, 21) of the first type is provided in a showcase (10, 20) for displaying foods in a supermarket, and any one of the application units (41 or 51) of the second type are provided for conditioning the air in the supermarket.

7. The refrigeration system of claim 2, characterized in that each of the application units (11, 21) of the first type is provided in a showcase (10, 20) for displaying foods in a supermarket, and any one of the application units (41 or 51) of the second type are provided for conditioning the air in the supermarket.

* * * * *